United States Patent [19]

Bolt et al.

[11] Patent Number: 4,527,694

[45] Date of Patent: Jul. 9, 1985

[54] SUSPENDABLE HANGER FRAMEWORK ASSEMBLY

[76] Inventors: William S. Bolt, 1010 Cuyahoga Dr., Bartlett, Ill. 60103; Kenneth W. Wood, 1034 Viking Ct., Batavia, Ill. 60510

[21] Appl. No.: 382,587

[22] Filed: May 27, 1982

[51] Int. Cl.[3] ..... A47F 7/16

[52] U.S. Cl. ..... 211/46; 211/45; 211/26; 211/162; 312/184; 361/212

[58] Field of Search ..... 211/46, 45, 113, 162, 211/26, 105.2, 134; 312/184, 183; 206/328; 361/212

[56] References Cited

U.S. PATENT DOCUMENTS 2,336,802 12/1943 Posner ..... 211/45 X
3,830,374 8/1974 Kassimir ..... 211/134 X

FOREIGN PATENT DOCUMENTS 113161 2/1945 Sweden ..... 312/184
323006 8/1957 Switzerland ..... 312/184

*Primary Examiner*—Ramon S. Britts
*Assistant Examiner*—Blair Johnson
*Attorney, Agent, or Firm*—Lester N. Arnold

[57] ABSTRACT

A novel hanger framework assembly comprises an inserted assembly to be placed within the interior confines of industry-known tote boxes as commonly used for the handling, carrying, storing and shipping of electrostatic charge sensitive electronic circuits, PC boards and components, which framework assembly includes novel channel configuration utilized to capture and guide movements of hanger bar members, to receive insertable corner brace members and an encircling strap fastener, and within which channels the end portions of suspendable insulating materials are captured, which insulating materials also comprise flexible folders to be suspended from the hanger bar members and within which objects to be protected from electrostatic discharge can be placed.

4 Claims, 9 Drawing Figures

SUSPENDABLE HANGER FRAMEWORK ASSEMBLY

BACKGROUND OF THE INVENTION

This invention relates to a suspendable insertable hanger framework assembly, and more particularly, to a hanger framework assembly having improved suspension of depending materials from the framework assembly and improved hanger to framework interconnection.

The field of the present invention relates to the use of open-bin pans or so-called tote boxes or containers for the assembly-line or production handling, storing and/or transporting of electrostatic-sensitive printed circuit PC boards and a variety of other electronic circuits, assemblies, components and/or discrete parts. It is common practice in the relevant art to utilize open-top tote pans to hold PC boards, etc., and to construct such tote pans of materials having semi-conductive or dielectric properties affording charge shielding characteristics to protect the carried product from exteriorly emanating electrostatic charges and/or radiating fields. Thus, the carried product is to be protected against possible destruction or serious degradation precipitated through inadvertent exposure to externally produced electrostatic charges and/or radiating energy fields.

In accordance with the present invention, a novel hanger framework assembly is presented which is insertable into the open bins or tote pans, and from which a plurality of electrostatic shielding divider means or partitioning means are suspended from hanger means which are slideable with respect to and which hanger means are captured in interconnection with a novel framework assembly. It is particularly advantageous to provide that the partitioning means comprise suspendable open-type folders or pouches very similar in nature to standard file folders, and within which individual PC boards and/or electronic components can be placed for improved quality of electrostatic shielding. The state of the art has thus been improved by this invention to provide charge shielding within the interior confines of the tote pans in addition to providing previously known charge shielding from sources lying or disposed exteriorly of the tote pans. It is readily obvious that an increased number of carried products can be protected through the utilization of the present invention.

It is an object of the present invention to protect against inadvertent removal of the hanger means from the insertable framework assembly while providing for the relative ease of moving the hanger means with respect to the framework assembly whereby the opening and closing of suspended pouches and movements of pouches with respect to each other is made possible. The framework assembly is improved in its facility of being suspendable from the open and generally upper edge portions of the tote pans, and from the inclusion of channel means within which to interconnect the engaging outer edge portions of the hanger means, and within which to embed circumferentially extending fastener means for fastening together the individual frame members comprising the framework assembly. Additionally, the channel means are useful for capturing suspendable dielectric partitioning materials.

SUMMARY OF THE INVENTION

It is an object of the present invention to provide electrostatic charge shielding or charge sensitive electronic components within the interior confines of dielectric protective utility containers commonly known in the relative art as totes.

It is an object of the invention to provide a portable framework assembly including moveable hanger means from which a number of dielectric insulating partitions can be suspended.

It is another object of the invention to provide means of suspending the inserted hanger framework assembly from the open and generally upper edge portions of the tote boxes.

It is yet another object of the invention to provide novel channel configuration for the frame members comprising the framework assembly, within which channels it is convenient to capture the extremities of the hanger means, as well as to include corner brace means and circumferentially extending strap fastener means for joining the frame members together into an integral framework assembly.

It is still another object to provide improved suspension means by which the framework assembly is to be suspended from the upper peripheral edge portions of the tote boxes.

It is a further object to improve the framework assembly whereby the suspension means are included as an integral portion of selected ones of the component frame members.

A generally rectangular shaped framework includes in combination side frame members and end frame members interconnected at adjacent corners by corner brace means and a continuous circumferentially extending strap means which combines with the corner brace means to comprise framework fastener means. Each of the frame members defines a pair of U-shaped channel openings or troughs therein, which channels open or face in opposite directions with respect to each other as determined by the generally S-shaped cross sectional configuration of the frame members. An upper channel of a frame member faces or opens inwardly of the closed loop framework assembly, and a lower channel thereof faces or opens outwardly therefrom. A plurality of traversely extending hanger bar or rod members, comprising hanger means, are placed to extend across the opening of the framework assembly, that is, between oppositely disposed frame members. The extremities of the hanger bars are configured to be accepted to slide along the inner channels into which the extremities are inserted and to be captured therein against perpendicular movement with respect to the channel. Adjacent pairs of hanger bars are used to hold a suspended and flexible pouch or file folder of conventional configuration wherein at least the side walls thereof are constructed of materials having dielectric insulating characteristics, and into which folders objects which are to be protected against electrostatic charges and radiating fields can be placed.

Other objects and advantages of this invention will become apparent from consideration of the following detailed description, wherein reference is made to the accompanying drawing disclosing a preferred embodiment of the present invention.

DRAWING

DETAILED DESCRIPTION

Figure 1:
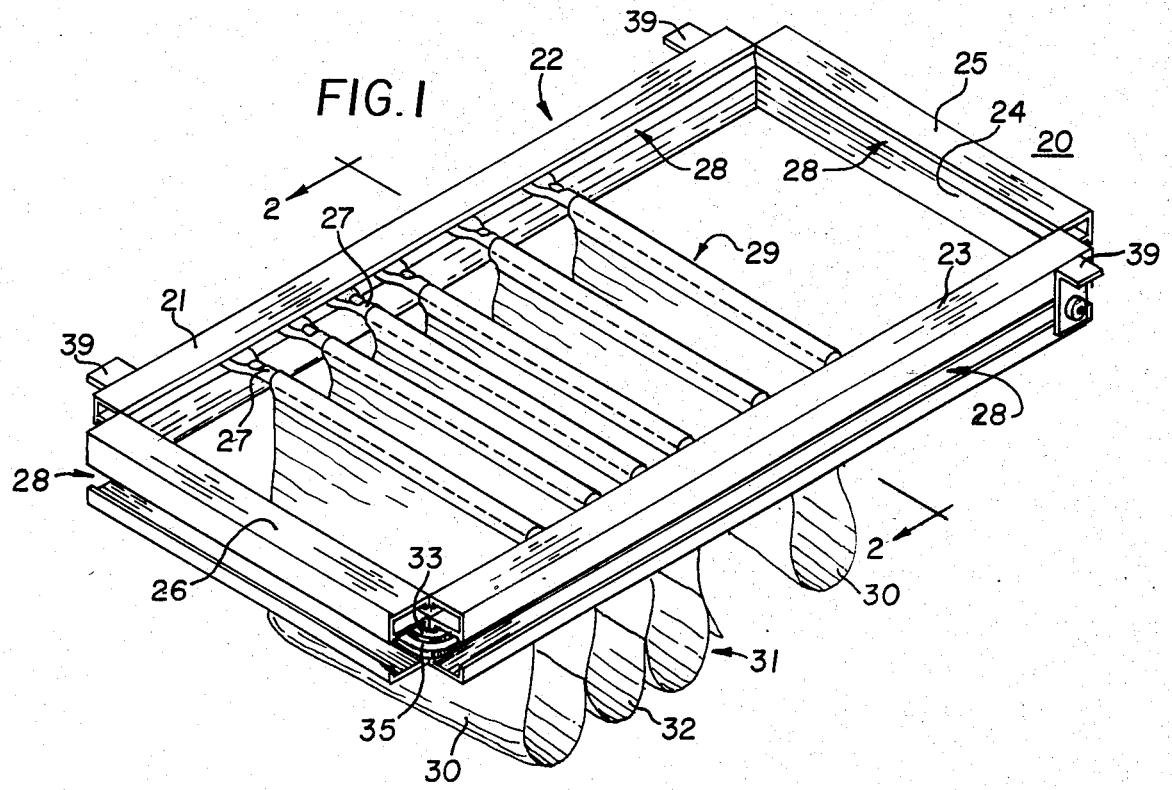
FIG. 1 is a perspective view of the combination hanger framework assembly which comprises the present invention, and showing a plurality of suspendable pouch means depending from movable hanger means.

There is shown in the drawing, and more particularly, in FIG. 1 thereof, a novel suspendable hanger framework assembly 20 including in combination side frame members 21 and 23 and end frame members 25 and 26 which are interconnected to form a generally rectangular shaped planar framework assembly 22 defining a central opening 24. The combined hanger framework assembly 20 is comprised of the framework 22 and a plurality of hanger bar or rod members 27 comprising hanger means 29. The hanger bar members 27 are shown to extend traversely across the central opening 24, and to have the extremities or end portions thereof insertable and captured within channel means 28 of the side frame members 21 and 23. There are provided in accordance with the object of the invention, individual file-type pouches or folders 30 comprising holding means 31, each of which depends or is suspended from an adjacent pair of the hanger bars 27. The file folders 30 are constructed of materials selected for electrostatic charge insulating and radiating field protective properties. Objects such as electrostatic charge sensitive PC boards and electronic circuits and components, not shown in the drawing, can be placed in the interior confines of a selected shielding pouch 30, and protected against degradation or destruction caused by dissipation of charges and fields through the carried object.

The framework assembly 22 is preferably fastened or held together in part by the use of corner brace members or means 33 which are insertable into the channel means 28 of the adjacently disposed frame members, that is, side frame members 21 and 23 are joined to end frame members 25 and 26. The interconnected frame members comprising the framework assembly 22 are then further fastened together through employment of continuous strap-like band means 35 which extends circumferentially around the framework assembly 22 and engages the corner braces 33. The band 35 is adapted to be inserted within the channel means 28. The combination hanger framework assembly 20 is suspendable within the confines of box-like open-topped container means, commonly referred to in the relevant art as tote pans or totes, portions of which are shown in dashed lines in the drawing at 40. Suspension of the assembly 20 is accomplished by employment of suspension means 37 of which a particular side mounted and inverted L-shaped hanger member configuration is shown in FIG. 1 at 39.

The configuration of the pouches 30 can be altered or varied to suit a number of object handling capabilities, for example, the pouches can be flexible and pliable or can be made stiff and generally inflexible, or soft sidewalls combined with rigid bottom-walls. The pouches 30 can be individual and separate pouches, or an intermediate wall section member 32 can be used to join adjacent ones of individual pouches 30 to define or form continuous pouches 30 wherein each opening which lies between adjacent hanger bars 27 comprises the opening of a pouch 30. The depth and width dimensions of the pouches 30 are obvious choices of application and do not comprise a part of the present invention, nor do the composition and type of material or electrical insulating properties of the material from which the pouches 30 are comprised.

Figure 2:
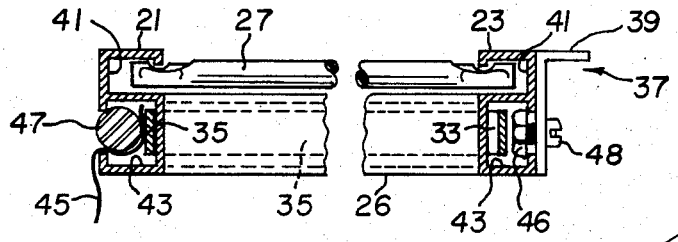
FIG. 2 is an elevated sectional view of the hanger framework assembly of FIG. 1, generally taken along the line 2—2 of FIG. 1 but omitting pouch means for clarity and including an additional improvement feature.

In accordance with the present invention, each of the frame members 21, 23, 25 and 26 are configured in a generally S-shaped cross-sectional configuration, see FIG. 2, to thereby define a pair of oppositely facing channel openings, raceways or troughes as comprise the channel means 28. In particular, there is provided an upper channel 41 and a lower channel 43 with respect to the orientation thereof shown in the drawing. The upper channel 41 opens inwardly of the central opening 24 of the framework assembly 22, and receives therein the novel configured end portion or extremity 27*a* of each of the hanger bars 27. The lower channel 43 opens outwardly of the central opening 24, and receives therein the corner braces 33, the encircling strap or band 35, and the opening thereof provides a convenient means to capture and depend therefrom, a flexible elongated flap of insulating material 45 which is held in place by force fitted cord strip means 47 which is inserted into the lower channel opening 43. The flap material 45 can be used as either a top covering protective flap or a bottom and side covering protective flap or both to add protective insulating material to the application of the present invention. The flap material 45 is not shown in the drawing except for the discontinuous section thereof shown in FIG. 2, but the provision thereof is thought to be obvious from this teaching when considered in combination with the drawing at FIG. 2. Further shown in FIG. 2 the L-shaped hanger brackets 39 are captured in their attachment to the side face of the frame members 21 and 23 by use of conventional fastener devices such as a nut 46 and threaded bolt 48.

Figure 3:
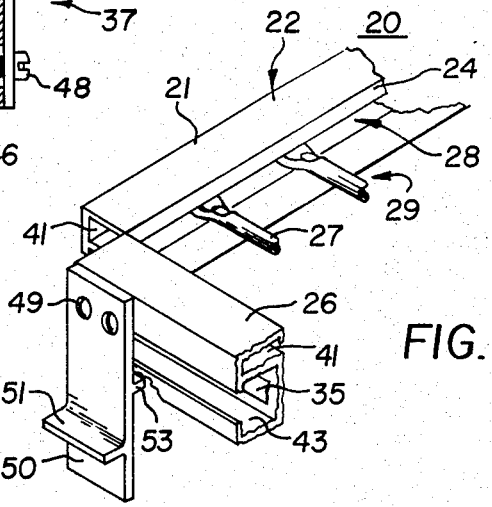
FIG. 3 is an isolated fractional perspective view of a portion of the framework assembly of FIG. 1 shown in combination with alternative suspension means.
Figure 4:
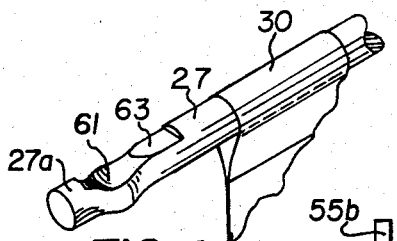
FIG. 4 is an isolated fractional perspective view of an extremity or end portion of a selected hanger bar of the hanger means.
Figure 5:
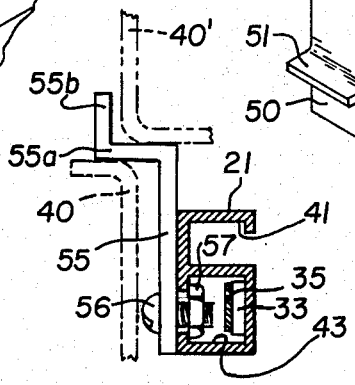
FIG. 5 is an elevated sectional view of a selected frame member of the framework assembly shown in combination with still an alternative suspension means.

FIG. 3 shows the hanger framework assembly 20 of FIG. 1 in a fragmentary view and without the disclosure of the pouches 30, in order to illustrate an alternative hanger embodiment 50 for the suspension means 37, which hanger 50 is comprised of flatwise elongated bar stock joined to the frame member 26 by means of threaded fasteners 49 interconnecting with the lower channel opening 43. The hanger 50 is conveniently referred to herein as a riser hanger member and includes an outer extending shoulder or ledge portion 51 and an inner protruding shoulder or ledge portion 53. As shown in FIG. 3, the inner ledge portion 53 provides a shoulder upon which the connected frame member 26 is supported, and the outer ledge portion 51 provides a shoulder which engages a selected upper edge portion of the tote 40, very similar to that engagement being shown in FIG. 5. FIG. 5 shows still another alternative hanger member 55 which is mounted to a selected frame member such as side frame member 21 by provision of a threaded bolt 56 and nut 57 captured within the channel 43. The hanger member 55 includes both an outwardly depending shoulder portion 55*a* and an upperly turned portion 55*b*. The hanger 55 will enable the framework assembly 22 to be suspended by provision of shoulder 55*a* thereof within the interior confines of a lowermost container means 40. Another container means 40' is readily supported above the lowermost container means 40 through provision of shoulder portions 55*a* and 55*b*. In summary therefore, the riser hanger member 50 can be used to position the hanger framework assembly 20 above the top planar region of a selected container means 40; and the hanger member 55 can be used to mount the hanger framework assembly 20 relatively flush with the top planar region of the container means 40, or can provide a recessed or lowered mounting thereof with respect to the top planar region of the tote 40.

In accordance with the preferred embodiment of the invention disclosed in the drawing, the hanger bar members 27 are each provided on the outer extremities thereof with a recessed area 61 positioned inwardly of the diametrical outer edge portion 27*a*. The unaltered edge portion 27*a* therefore presents a raised portion with respect to the recessed area 61, and is intended to be received within the channel opening 41. The channel opening 41 is itself defined in part by a downwardly turned ledge or edge portion 64 which extends into the recessed area 61 with the edge portion 27*a* inserted into the receiving channel 41. The depth of the recessed area 61 and the downward extension of the edge portion 64 of the frame members is of course a matter of design and preselection; however, the design must provide that the frame edge portion 64 and hanger edge portion 27*a* would engage and interfere with the direct perpendicular withdrawal of the hanger bar 27 from its insertion into the channel 41. An adjacent flatlike shoulder portion 63 is shown in the drawing as an inward extension of the recessed area 61, and is provided merely to assure sufficient extension of the recessed area 61 inwardly along the hanger bar 27. It has been found that the hanger bars 27, when moved along the length of the channel opening 41, can become angularly positioned with respect to the frame members 21 and 23. If the recessed area 61 is enlarged in width as opposed to depth, the angular or askewed position of the hanger bar 27 presents no interference between the hanger bar 27 and the frame edge portion 64, and thus, no undesirable binding of the hanger bars 27 within the raceways 41. The shoulder portion 63 comprises merely a functional extension on the recessed area 61.

Figure 7:
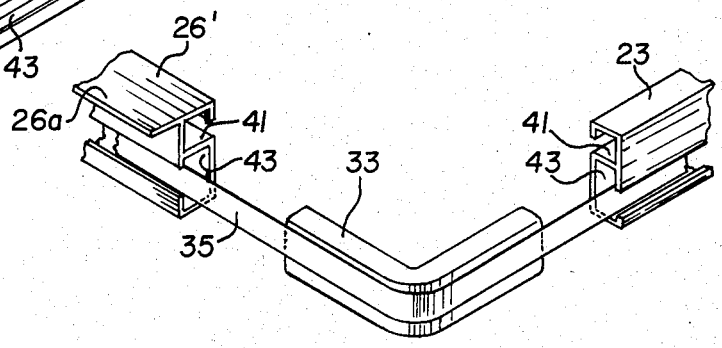
FIG. 7 is an exploded fractional perspective view of adjacently placed frame members showing corner brace means and encircling fastener means by which the frame members are interconnected.
Figure 8:
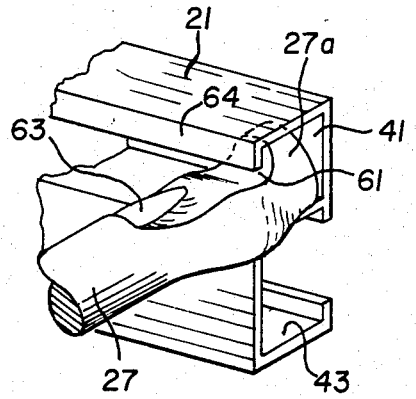
FIG. 8 is an isolated fractional perspective view showing the insertion of hanger means extremity into channel means provided on the frame member.

FIG. 8 shows most clearly the insertion of the hanger bar 27 into the end opening of the channel 41 of the frame member 21, wherein the end poritons 27*a* are inserted laterally into the channel 41 as is enabled by the recessed area 61. Once the hanger bars 27 are installed into the channel 41 on each of the side frame members 21 and 23, the lateral withdrawal thereof is prevented by the assembly of the end frame members 25 and 26. The corner braces 33 can be designed, as shown in FIG. 7, to be received into the channel openings 43 with a relatively snug fit, and the depth of the insertion into the channel 43 is optional. Next, the interconnected hanger framework assembly 20 is held together by providing the strap or band means 35 which is designed to be inserted into the lower channel opening 43 and which encircles circumferentially the framework assembly 22. The strap means 35 engages the outer surface of the corner braces 33 as is shown clearly in FIG. 7. Preferably, the free end portions of the strap 35 are permanently joined together to comprise a one-piece integral strap fastener device, although suitable provision could be made for the strap means 35 to be removable if desired in particular applications. Alternatively, the channel openings 41 could be enlarged at a selected position thereof, perhaps adjacent to a terminal end portion thereof, whereby the frame edge portion 64 is reduced or eliminated altogether so as to permit the direct withdrawal of the hanger edge portion 27*a* from the channel opening 41. In this manner, the hanger bars 27 could be removed or added as desired without disassembly of the framework assembly 22. The above-described alternative enlargement of the channel opening 41 is not shown in the drawing as its feature is deemed understandable from this enabling description.

Figure 6:
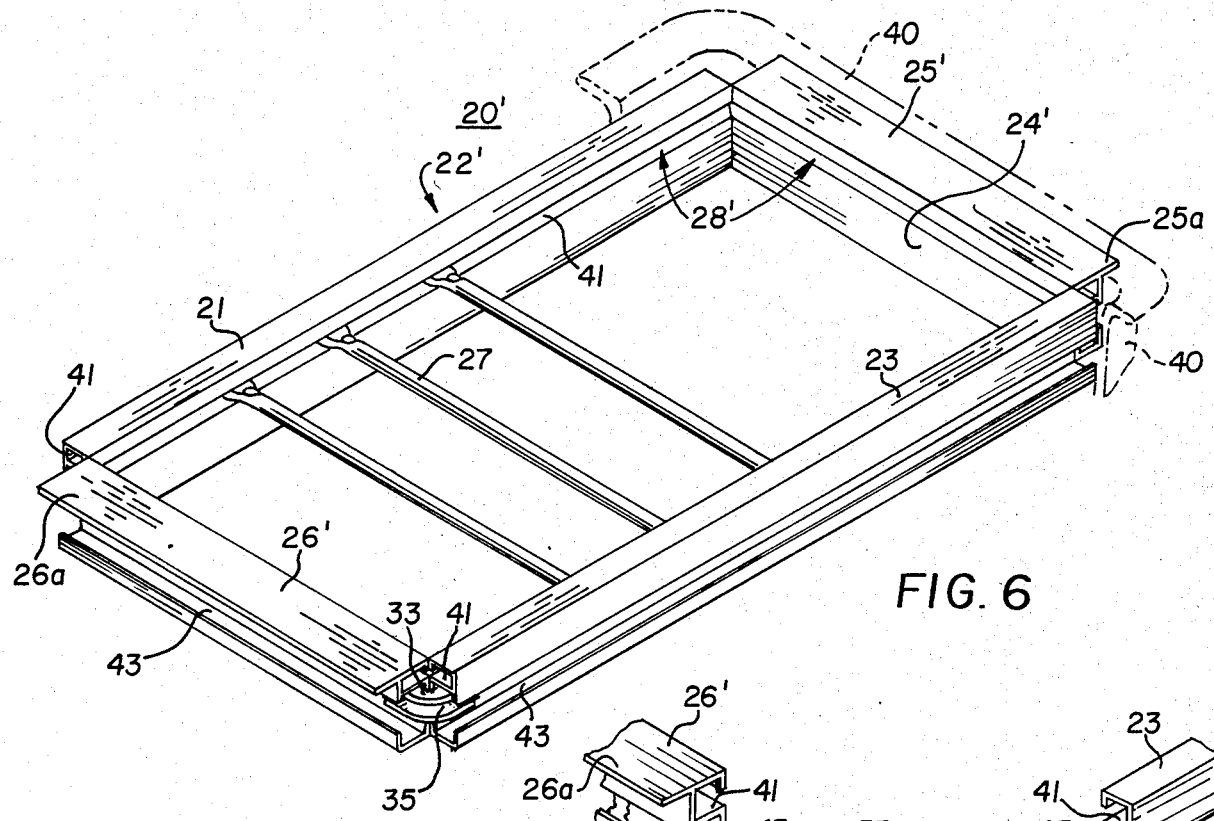
FIG. 6 is a perspective view of an alternative hanger framework assembly showing in dashed lines the insertion thereof within top-opening container means.

There is shown in FIG. 6 an alternative embodiment of the hanger framework assembly 20 including in combination the side frame members 21 and 23 and modified versions of the end frame members 25 and 26, herein identified as 25' and 26'. The side frame members 21 and 23 are still interconnected to the end frame members 25' and 26' through provisions of the corner brace members 33 and the encircling strap means 35, and the interconnected framework assembly 20' defines the central opening 24 across which are placed a predetermined number of the hanger bars 27. The hanger bars 27 are similarly insertable into the channel opening 41 without change, and the detailed description of the alternative framework assembly 22' is abbreviated herein and more specifically directed to the modification made to the end frame members 25' and 26'. At the outset it should be understood that the same modification could alternatively have been made to the side frame members 21 and 23 or to all the frame members of the framework assembly 22.

Figure 9:
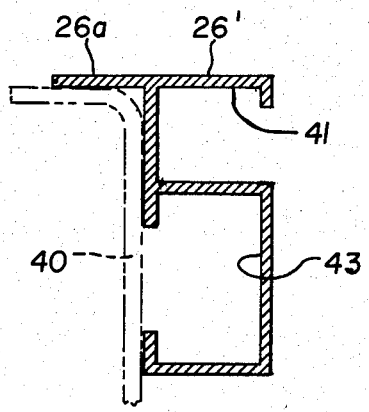
FIG. 9 is a perspective view of an alternative sectional configuration for the frame member of the present invention incorporating means for suspending the framework assembly with respect to the container means, a portion of which is indicated in dashed lines.

The end frame members 25' and 26' have been modified to provide outwardly extending top edge portions 25*a* and 26*a*, respectively, and which are extendable to overlie selected upper edge portions of the tote 40 and which function to enable the suspension of the framework assembly 22" within the interior space of the tote 40. Only a selected upper edge portion of the tote 40 is shown in dashed lines in FIG. 6 for illustration purposes. FIG. 9 shows a sectional view of the modified frame member 26', wherein it is clearly seen that the L-shaped hanger bracket 39 is no longer needed because of the outwardly extending portion 26*a*. Other modifications to the sectional configuration of the frame members 21, 23, 25 and 26 become apparent from a consideration of the various attachment or suspension means as have been heretofore disclosed for suspending the framework assembly 22' within or above the confines of the associated totes 40. It is only required that the channel openings 41 and 43 be preserved, and that the frame edge portion 64 be preserved to complement the insertional engagement between the channel 41 and the extremities *27a* of the hanger bars 27.

Other alternative equally useful and/or equivalent configurations and suspension arrangements could no doubt be thought of and/or employed to accomplish the intent and purpose of the present invention. It is to be understood that while the present invention has been shown and described with reference to the preferred embodiments thereof, the invention is not limited to the precise forms set forth, and that various modifications and changes may be made therein without departing from the true spirit and scope of the present invention.

What is claimed is:

1. An improved hanger framework assembly to be suspended in the central opening of box-like container means including in combination side frame members and end frame members to be interconnected to comprise an integral framework assembly and defining a central opening therebetween, each of said frame members defining first and second channel openings therein, and each thereof having a first frame edge portion partially defining the first channel opening, hanger bar means extendible between oppositely disposed frame members and being insertable within the first channel openings and movable therealong, each hanger bar means including recessed portions thereof disposed inwardly adjacent to the end portion extremities thereof, said first edge portions of the frame members extending into the recessed portions of the hanger bar means, respectively, with the hanger bar means inserted into the first channel openings for preventing withdrawal of the hanger bar means from the first channel openings, pouch means suspendable from the hanger bar means, means for suspending the framework assembly with respect to the container means, corner brace means extendible into the second channel openings of abutting side frame members and end frame members for interconnecting the framework assembly, strap means circumferentially encircling the framework assembly and engageable with the corner brace means and insertable within the second channel openings of the frame members, respectively, elongated electrostatic charge insulting means (are) selectively suspended from the side frame members and end frame members, and strap fastener means and selected edge portions of the insulating means (are) to be received into the second channel openings for suspending the insulating means.

2. An improved suspendable hanger framework assembly comprising in combination: a pair of spaced-apart side frame members and a pair of end frame members adjoining the ends of the side frame members to define therebetween a central opening, the frame members having first and second channels therein, hanger bar means extending across the central opening of the framework assembly with the outer end extremities thereof insertably received within the first channels of the side frame members and being movable therealong, means for preventing withdrawal of the hanger bar means from the first channels, pouch means suspendable from the hanger bar means, first fastener means for fastening the side frame members and end frame members together, said first fastener means being received into the second channel openings of the frame members, elongated electrostatic charge insulating means suspended from selected ones of the side frame members and end frame members, and second fasteners means and selected edge portions of the insulating means being received into the second channel openings of the frame members.

3. An improved hanger framework assembly as claimed in claim 2 wherein the elongated electrostatic charge insulating means is extendable beginning from engagement with a selected side frame member and extending across and beneath the pouch means and terminating with engagement with the spaced-apart side frame member.

4. An improved hanger framework assembly as claimed in claim 3 wherein the elongated electrostatic charge insulating means is extendable beginning from engagement with a selected end frame member and extending across and over the pouch means and terminating with engagement with the spaced-apart and frame member.

* * * * *